US012044100B2

(12) United States Patent
Ross et al.

(10) Patent No.: US 12,044,100 B2
(45) Date of Patent: Jul. 23, 2024

(54) WELL INSTALLATIONS AND SUBSURFACE SAFETY VALVES

(71) Applicant: METROL TECHNOLOGY LTD, Aberdeen (GB)

(72) Inventors: Shaun Compton Ross, Aberdeen (GB); Steven Martin Hudson, Aberdeen (GB); Leslie David Jarvis, Aberdeen (GB)

(73) Assignee: METROL TECHNOLOGY LTD, Aberdeenshire (GB)

( * ) Notice: Subject to any disclaimer, the term of this patent is extended or adjusted under 35 U.S.C. 154(b) by 0 days.

(21) Appl. No.: 17/920,576

(22) PCT Filed: Mar. 29, 2021

(86) PCT No.: PCT/GB2021/050769
§ 371 (c)(1),
(2) Date: Oct. 21, 2022

(87) PCT Pub. No.: WO2021/214426
PCT Pub. Date: Oct. 28, 2021

(65) Prior Publication Data

US 2023/0160280 A1 May 25, 2023

(30) Foreign Application Priority Data

Apr. 24, 2020 (EP) ..... 20171426

(51) Int. Cl.
*E21B 47/12* (2012.01)
*E21B 34/06* (2006.01)
*E21B 34/16* (2006.01)

(52) U.S. Cl.
CPC ..... *E21B 34/066* (2013.01); *E21B 34/16* (2013.01); *E21B 47/12* (2013.01)

(58) Field of Classification Search
CPC ..... E21B 34/066; E21B 34/16; E21B 47/12; E21B 34/06; E21B 47/13; E21B 43/14
See application file for complete search history.

(56) References Cited

U.S. PATENT DOCUMENTS 4,617,960 A * 10/1986 More ..... E21B 47/26 137/554
4,796,708 A * 1/1989 Lembcke ..... E21B 47/13 340/853.3

(Continued)

FOREIGN PATENT DOCUMENTS

| | | |
|---|---|---|
| EP | 2313797 | 4/2011 |
| GB | 2461065 | 12/2009 |
| WO | 2009153551 | 12/2009 |

OTHER PUBLICATIONS

Development and Qualifications of a New Wireless Controlled Retrofit Safety Valve, An Alternative to Well Workover That Enhances Well safety and Maximizes Production Uptime, Feb. 2011, 9 pages.

(Continued)

*Primary Examiner* — Kipp C Wallace
(74) *Attorney, Agent, or Firm* — Nixon & Vanderhye, PC

(57) ABSTRACT

A subsurface safety valve control system including a downhole station 5 for provision in downhole metallic structure (2) of a well installation which comprises a subsurface safety valve V having an open state allowing flow through the valve and a closed state obstructing flow through the valve. The downhole station (5) is arranged for picking up electrical signals from the downhole metallic structure (2) to obtain valve control signals and for outputting control signals for controlling the subsurface safety valve V in dependence on the signals picked up from the downhole metallic structure. The downhole station (5) comprises a hardware electronics channel (5*a*) for handling electrical signals picked up from the downhole metallic structure and (Continued)

Figure 1:
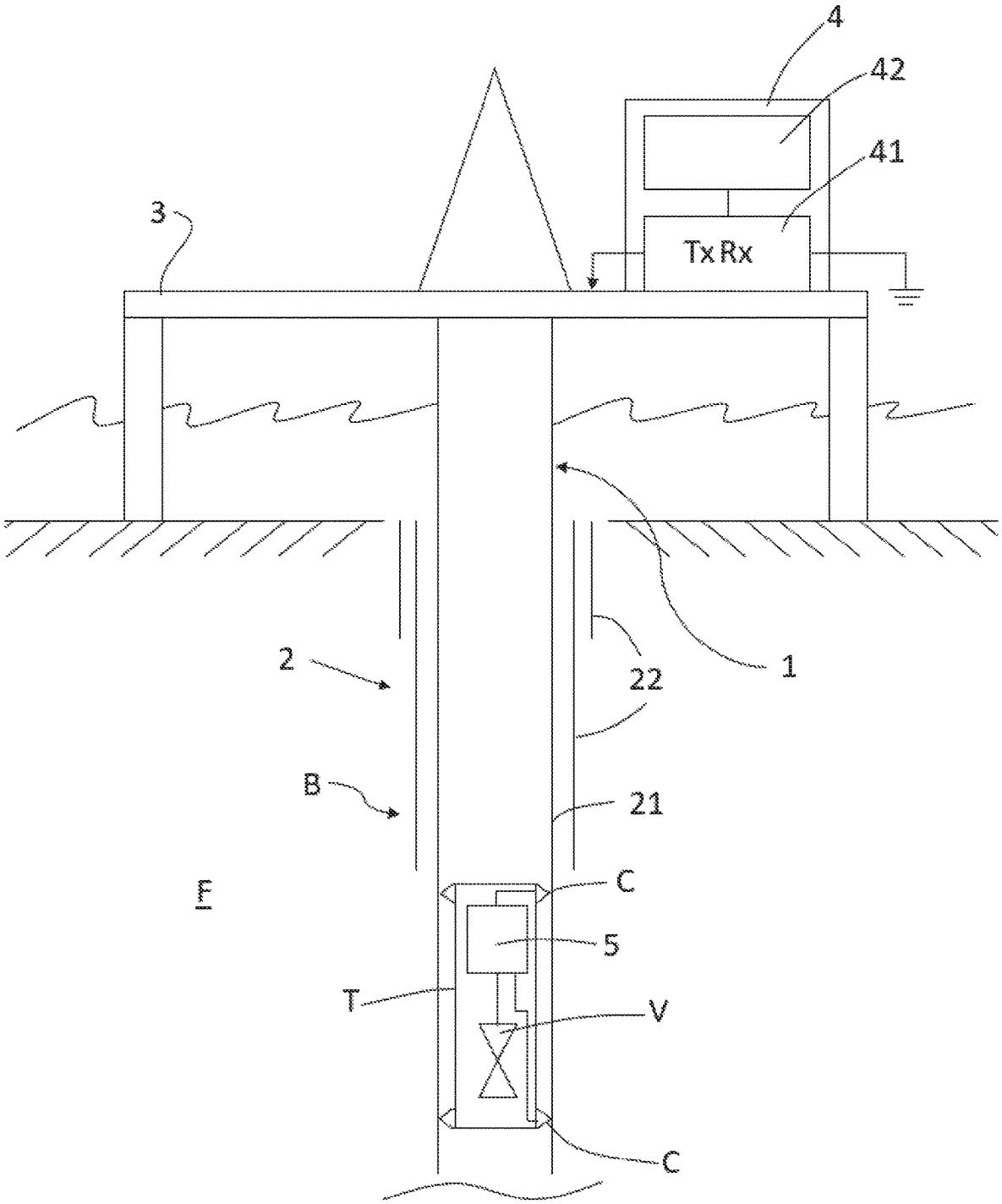

the hardware electronics channel (5*a*) is arranged for detecting the presence and/or absence of hold valve open signals. The downhole station (5) is arranged to cause the subsurface safety valve V to be held in the open state whilst expected hold valve open signals are received and is arranged to cause the subsurface safety valve to move to the closed state in the absence of expected hold valve open signals.

28 Claims, 8 Drawing Sheets

(56) References Cited

U.S. PATENT DOCUMENTS

| | | | | |
|---|---|---|---|---|
| 4,852,648 | A | 8/1989 | Akkerman et al. | |
| 4,886,114 | A * | 12/1989 | Perkins | E21B 34/066 166/66.7 |
| 5,293,551 | A * | 3/1994 | Perkins | E21B 34/066 251/129.01 |
| 5,587,707 | A * | 12/1996 | Dickie | H04B 13/02 340/854.4 |
| 6,199,629 | B1 * | 3/2001 | Shirk | E21B 34/06 166/66.4 |
| 9,022,102 | B2 | 5/2015 | Hudson et al. | |
| 2003/0227393 | A1 * | 12/2003 | Vinegar | E21B 34/066 340/854.3 |
| 2005/0051334 | A1 | 3/2005 | Baugh et al. | |
| 2009/0090501 | A1 * | 4/2009 | Hansen | E21B 34/066 166/72 |
| 2009/0314485 | A1 | 12/2009 | Millet et al. | |
| 2011/0094752 | A1 * | 4/2011 | Hudson | G01V 11/002 166/373 |
| 2020/0318462 | A1 * | 10/2020 | Ross | E21B 47/13 |
| 2020/0370394 | A1 * | 11/2020 | Cai | E21B 34/066 |

OTHER PUBLICATIONS

Electromagnetic Surface-Controlled Sub-Surface Safety Valve: An immediate Solution to Secure Wells with Damaged Control Line, Sep. 1, 2010, 9 pages.

European Patent Office Extended Search Report for Application No. 20171426 dated Oct. 16, 2020, 7 pages.

PCT Notification of Transmittal of the International Search Report and Written Opinion of the International Searching Authority or Declaration for PCT/GB2021/050769 dated Jun. 24, 2021, 13 pages.

* cited by examiner

WELL INSTALLATIONS AND SUBSURFACE SAFETY VALVES

This application is the U.S. national phase of International Application No. PCT/GB2021/050769 filed Jun. 24, 2021, which claims priority to European Application No. 20171426.8 filed Apr. 24, 2020, the entire contents of each of which is hereby incorporated by reference.

This invention relates to well installations including subsurface safety valves and control systems for controlling subsurface safety valves.

In general there is a requirement to provide a subsurface safety valve in well installations. In this specification "well installation" refers to well installations used in the oil and oil/gas industry for extracting product, that is oil and/or gas, from a formation or for exploring a formation, monitoring a formation, or injecting liquids into a formation and so on.

As well as a general requirement to provide subsurface safety valves in well installations a particular issue can arise when an existing subsurface safety valve fails or has other issues. In those cases it is particularly advantageous if a subsurface safety valve can be retrofitted.

For example currently there are a number of existing platform production wells which are currently shut in and not producing due to issues with the installed safety valves. Typically these safety valves incorporate a locator nipple in order to allow a wireline deployed lock to be installed to shut in the well or a wireline deployed isolation sleeve to be installed to hold the safety valve open.

In such a case it would be desirable to provide a replacement safety valve which could be efficiently retrofitted into these wells in order to allow production to recommence.

This application relates to ideas and techniques which may be useful in such circumstances.

According to one aspect of the present invention there is provided a well installation comprising downhole metallic structure comprising downhole metallic pipe for directing oil and/or gas towards the surface, a subsurface safety valve having an open state allowing flow through the valve and a closed state obstructing flow through the valve and hence obstructing flow, in the downhole metallic pipe, of oil and/or gas towards the surface, and a control arrangement for controlling operation of the subsurface safety valve, wherein the control arrangement comprises an out of hole station and a downhole station, the out of hole station is arranged for transmitting valve control signals to the downhole station by applying electrical signals to the downhole metallic structure and the downhole station is arranged for picking up electrical signals from the downhole metallic structure and for controlling the subsurface safety valve in dependence on the valve control signals.

This can provide for the remote and wireless control of a subsurface safety valve, which can for example assist in the retrofitting of such a device.

The well installation may comprise a subsurface safety valve arrangement which comprises the downhole station and the subsurface safety valve.

According to another aspect of the present invention there is provided a subsurface safety valve control system downhole station for provision in downhole metallic structure of a well installation which comprises a subsurface safety valve having an open state allowing flow through the valve and a closed state obstructing flow through the valve, wherein the downhole station is arranged for picking up electrical signals from the downhole metallic structure to obtain valve control signals and for outputting control signals for controlling the subsurface safety valve in dependence on the signals picked up from the downhole metallic structure.

According to another aspect of the present invention there is provided a subsurface safety valve arrangement for installation in downhole metallic structure in a well installation, the subsurface safety valve arrangement comprising a subsurface safety valve having an open state allowing flow through the valve and a closed state obstructing flow through the valve, and a downhole station arranged for picking up electrical signals from the downhole metallic structure to obtain valve control signals and for controlling the subsurface safety valve in dependence on the signals picked up from the downhole metallic structure.

In one set of embodiments the valve control signals comprise hold valve open signals. The out of hole station may be arranged for transmitting hold valve open signals. The downhole station may be arranged to cause the subsurface safety valve to move to the closed state in the absence of expected hold valve open signals.

The downhole station may comprise a hardware electronics channel for handling electrical signals picked up from the downhole metallic structure. The hardware electronics channel may be arranged for detecting the presence and/or absence of hold valve open signals.

In one set of embodiments, the downhole station comprises a hardware electronics channel for handling electrical signals picked up from the downhole metallic structure and the hardware electronics channel is arranged for detecting the presence and/or absence of hold valve open signals, and the downhole station is arranged to cause the subsurface safety valve to be held in the open state whilst expected hold valve open signals are received and is arranged to cause the subsurface safety valve to move to the closed state in the absence of expected hold valve open signals.

In one set of embodiments, the valve control signals comprise hold valve open signals, the out of hole station is arranged for transmitting hold valve open signals, the downhole station comprises a hardware electronics channel for handling electrical signals picked up from the downhole metallic structure and the hardware electronics channel is arranged for detecting the presence and/or absence of hold valve open signals, and the downhole station is arranged to cause the subsurface safety valve to be held in the open state whilst expected hold valve open signals are received and is arranged to cause the subsurface safety valve to move to the closed state in the absence of expected hold valve open signals.

The use of a hardware electronics channel can provide a robust system for determining the presence or absence of a hold open signal to help guard against any false determination of a hold open signal and guard against any erroneous determination of an absence of a hold open signal. In particular it can help avoid use of software enabled systems in a manner where software errors might lead to false determinations.

The valve control signals may comprise auxiliary control signals which are distinct from hold valve open signals.

The out of hole station may be arranged for transmitting auxiliary control signals which are distinct from hold valve open signals. The downhole station may be arranged for detecting auxiliary control signals which are distinct from hold valve open signals.

The auxiliary control signals may be carried on a first carrier signal and the hold valve open signals may be carried on a second distinct carrier signal.

The auxiliary control signals and the hold valve open signals may be carried by a common carrier signal.

The hold valve open signals may comprise a common carrier signal and the auxiliary control signals may be modulated on to the common carrier signal.

Preferably, however, the auxiliary control signals and hold valve open signals are modulated on and carried by a common carrier signal. The out of hole station may be arranged for transmitting the hold valve open signals and the auxiliary control signals modulated on a common carrier signal. The downhole station may be arranged for receiving the hold valve open signals and the auxiliary control signals modulated on a common carrier signal.

The auxiliary control signals may be applied to the respective carrier signal using an orthogonal modulation technique to a modulation technique by which the hold valve open signals are applied to the respective carrier signal. Here the respective carrier signal may preferably be a common carrier signal.

This can facilitate the use of a single carrier to minimise complexity in the transmitter and/or receiver whilst minimising the risk that the auxiliary control signals will interfere with proper detection of the hold valve open signals.

By orthogonal modulation techniques we refer to techniques which modulate the carrier in ways which are independent of each other such that modulation to encode the auxiliary control signals does not adversely affect the hold valve open signals and their detection. This can be particularly useful where a hardware channel is used for handling the hold valve open signals—it may simplify and/or make more robust the detection of hold valve open signals.

As an example, frequency modulation, such as frequency shift keying, may be used for encoding one of the hold valve open signals and the auxiliary control signals and amplitude modulation may be used for encoding the other the hold valve open signals and the auxiliary control signals.

In one set of embodiments the hold valve open signals are encoded by frequency modulation on to a common carrier signal and the auxiliary control signals are encoded by amplitude modulation on to the common carrier signal.

The hardware electronics channel may comprise a carrier detector arrangement for detecting the presence of hold valve open signals and/or a carrier for hold valve open signals having a frequency within a predetermined frequency range.

The carrier detector arrangement may comprise a phase locked loop arrangement.

Where a common carrier signal is used the carrier detector arrangement, say phase locked loop arrangement, may be arranged for detecting the presence of the common carrier.

In a first set of embodiments detection at the downhole station of the presence of hold valve open signals and/or a carrier for hold valve open signals having a frequency within a predetermined frequency range by the carrier detector arrangement is sufficient to cause the downhole station to hold the valve open. In other embodiments the downhole station is configured to require determination of a further signal characteristic in received valve control signals to maintain the valve open.

The hardware electronics channel may comprise a demodulator for demodulating received signals to acquire a demodulated signal and a detection arrangement for detecting a predetermined signal characteristic in the demodulated signal which predetermined signal characteristic indicates that the received signals comprise hold valve open signals wherein the downhole station is arranged to hold the valve open in response to the detection that the received signals comprise hold valve open signals.

Preferably the hardware electronics channel comprises a carrier detector arrangement for detecting in received signals the presence of a carrier signal having a frequency within a predetermined frequency range; and the hardware electronics channel comprises a demodulator for demodulating received signals to acquire a demodulated signal and a detection arrangement for detecting a predetermined signal characteristic in the demodulated signal which predetermined signal characteristic indicates that the received signals comprise hold valve open signals, wherein the downhole station is arranged to hold the valve open in response to:

i) the detection of a carrier signal having a frequency within a predetermined frequency range; and ii) the determination that the received signals comprise hold valve open signals from the detection of the predetermined signal characteristic in the demodulated signal.

The detection arrangement may comprise a tone detector. The predetermined signal characteristic may comprise frequency. The tone detector may be implemented as a second, tone detecting phase locked loop. The predetermined signal characteristic may comprise a predetermined frequency or range of frequencies.

The carrier detector arrangement, say the phase locked loop, may be implemented using discrete components and non-programmable chips. The detection arrangement, say the tone detector, may be implemented using discrete components and non-programmable chips. That is to say without making use of any programmed components.

The phase locked loop may comprise components giving the phase locked loop a predetermined time constant. The phase locked loop may be arranged so that absence of the expected respective (either carrier or demodulated) signal for a predetermined time causes an indication that the expected signal is absent. The predetermined time will typically be related to, and selectable by adjusting, the time constant. The phase locked loop may output an output signal when the expected signal is present and the indication that the expected signal is absent may comprise a size of the output signal dropping below a predetermined threshold. Dropping below a predetermined threshold may comprise ceasing of the output.

The auxiliary control signals may comprise forced close signals for causing movement of the subsurface safety valve to the closed state irrespective of whether hold open signals are received.

Such forced close signals may, for example, be generated from an emergency shutdown system in the well installation, or in another example may be generated manually for non-emergency reasons, such as to selectively shut off a bore.

The auxiliary control signals may comprise re-open signals for causing re-opening of the subsurface safety valve when in the closed state.

The use of auxiliary control signals can provide an installation with enhanced flexibility and functionality.

The auxiliary control signals may be encoded onto the carrier as digital signals. The auxiliary control signals may be encoded onto the carrier using digital amplitude modulation.

The subsurface safety valve may have an associated address, and the auxiliary control signals may be arranged to carry an address so as to allow determination at the downhole station as to whether a received auxiliary control signal is intended for the subsurface safety valve.

The downhole station may comprise a software controlled electronics channel for handling electrical signals picked up from the downhole metallic structure. Preferably the software controlled channel is provided in addition to the hardware electronics channel. The software controlled electronics channel may be provided for detecting auxiliary control signals which are distinct from hold valve open signals.

The provision of a software controlled channel alongside the hardware electronics channel can facilitate the provision of a system with robust operation in relation to a fail-safe holding open of the valve in normal conditions making use of the hardware electronics channel, whilst providing enhanced functionality making use of the software controlled channel.

The software channel may comprise a controller for detecting auxiliary control signals. The controller may comprise a digital signal processor.

The controller may be arranged for generating and outputting valve control instructions based on the auxiliary control signals.

The valve control instructions may comprise force close output signal. The valve control instructions may comprise a re-open output signal.

The controller may be arranged for detecting a carrier on which the auxiliary control signals are carried. The controller may be arranged for generating an output to indicate that the carrier is received at the controller. The carrier may be a common carrier that also carries the hold open signals as mentioned above.

In one set of embodiments, the controller is arranged upon receipt of a forced close signal to cease outputting the output which indicates that the carrier is received at the controller, in order to force closure of the valve.

The downhole station may comprise determination means for determining whether at least one hold open condition is satisfied such that the valve should be held open and for outputting a hold open control signal to the valve when it is determined that the at least one hold open condition is satisfied.

The determination means may be arranged for determining whether at least two hold open conditions are satisfied in order to output a hold open control signal towards the valve. At least one of the hold open conditions may relate to the nature of the received signals. At least one of the hold open conditions may relate to a state of the downhole station and/or of the valve—say the health of a battery. Preferably the determination means is arranged for determining whether at least two hold open conditions relating to received signals are satisfied and at least one further hold open condition is satisfied in order to output a hold open control signal towards the valve.

The determination means may be arranged such that re-open signals for causing re-opening of the subsurface safety valve when in the closed state, will only cause re-opening of the subsurface safety valve when the determination means determines that said at least one hold open condition is satisfied.

The determination means may comprise a logic gate arrangement.

The hardware channel may comprise the logic gate arrangement. Where there is a software channel an output of this may feed into the logic gate arrangement.

An output from the carrier detector arrangement may feed into the determination means, say the logic gate arrangement. An output from the demodulated signal detection arrangement may feed into the determination means, say the logic gate arrangement.

At least one output of the controller in the software channel may fed into the determination means, say the logic gate arrangement.

The output from the controller to indicate that the carrier is received at the controller may be fed into the determination means, say the logic gate arrangement. The valve control instructions may be fed into the determination means, say the logic gate arrangement.

The downhole station may comprise a battery health monitoring system for monitoring the health of at least one battery at the downhole station and outputting a signal to indicate that said at least one battery is healthy. An output of the battery health monitoring system may feed into the determination means, say the logic gate arrangement.

The battery health monitoring system may be arranged for monitoring the health of a valve battery provided to power operation of the valve. The battery health monitoring system may be arranged for monitoring the health of a communication system battery provided to power operation of the downhole station in receiving valve control signals.

The logic gate arrangement may be arranged for outputting a hold open control signal towards the valve when respective hold open conditions are satisfied.

The logic gate arrangement may comprise a plurality of inputs and be arranged to output a hold open control signal towards the valve only when in receipt of signals with predetermined characteristics at each of the plurality of the inputs.

The logic gate arrangement may comprise, or consist of, an AND gate.

The well installation may comprise a plurality of subsurface safety valves each with a respective associated address. In some cases at least two of the subsurface safety valves may be provided within a single bore in a single well. Alternatively, where there is a plurality of subsurface safety valves each with a respective associated address, each subsurface safety valve may be provided in a respective different bore than others of the plurality of subsurface safety valves.

In some cases the well installation may be a multi-lateral well installation with a main bore and at least one lateral bore branching off of the main bore. A first subsurface safety valve may be provided in the main bore and a second subsurface safety valve may be provided in a bore amongst the at least one lateral bore.

In some cases the well installation may comprise a number of separate boreholes each provided with their own metallic structure.

The out of hole station may be arranged for applying electrical signals to said downhole metallic pipe in the first borehole and for applying electrical signals to a respective second set of downhole metallic structure in at least one further separate borehole.

The well installation may comprise well installation metallic structure comprising the downhole metallic structure and further metallic structure.

The further metallic structure may comprise a platform.

In some cases the well installation may comprise a first borehole in which said downhole metallic pipe is provided and at least one further separate borehole, which is provided with a respective second set of downhole metallic structure which is galvanically connected to said downhole metallic pipe in the first borehole via the further metallic structure, say via a platform.

The out of hole station may be arranged for applying electrical signals to the well installation metallic structure so as to apply electrical signals to said downhole metallic pipe in the first borehole and to the respective second set of downhole metallic structure in the at least one further separate borehole.

A further subsurface safety valve may be provided in a respective second set of downhole metallic pipe of the respective second set of downhole metallic structure in the at least one further separate borehole.

Where there is a plurality of subsurface safety valves each valve may have a respective address which allows the communication of auxiliary valve control signals to a specific valve or set of valves. Each valve in a well installation may have a unique address if desired.

In theory different hold valve open signals, say with different respective frequencies could be applied to the well installation for holding open the respective valves and these might be detected independently by the hardware channel at the downhole station associated with each valve. However, this is unlikely to be practically useful and may serve to diminish the robustness of the hold open communication.

The or each valve may be arranged so as to be biased towards the closed position. As an example the or each valve may be spring biased towards the closed position. The or each valve may latchable in the open position and the hold open valve signals may be used to hold the latch in place. In such a case where the hold open valve signals cease, the latch may be allowed to move out of engagement with the valve and allow the valve to close. This can help achieve fail-safe operation.

It is of interest if the source of power needed to close the valve does not come from the same source that is used to communicate the hold open signals to the valve.

The subsurface safety valve arrangement may comprise a downhole tool which is arranged for retrofitting in downhole metallic pipe. The subsurface safety valve arrangement may be arranged for retrofitting via wireline and may be arranged for retrofitting within production tubing.

According to another aspect of the present invention there is provided a subsurface safety valve control method for controlling a subsurface safety valve provided in a well installation comprising downhole metallic structure comprising downhole metallic pipe for directing oil and/or gas towards the surface, wherein the subsurface safety valve has an open state allowing flow through the valve and a closed state obstructing flow through the valve and hence obstructing flow, in the downhole metallic pipe, of oil and/or gas towards the surface, and the control method comprises:

using an out of hole station to transmit valve control signals to a downhole station by applying electrical signals to the downhole metallic structure;

using the downhole station to pick up electrical signals from the downhole metallic structure so picking up the valve control signals; and using the downhole station to control the subsurface safety valve in dependence on the picked up valve control signals.

Note that, in general terms and with any necessary modifications in wording, all of the further features defined above following any aspect of the invention above are applicable as further features of all other aspects of the invention defined above. These further features are not restated after each aspect of the invention merely for the sake of brevity.

Figure 2:
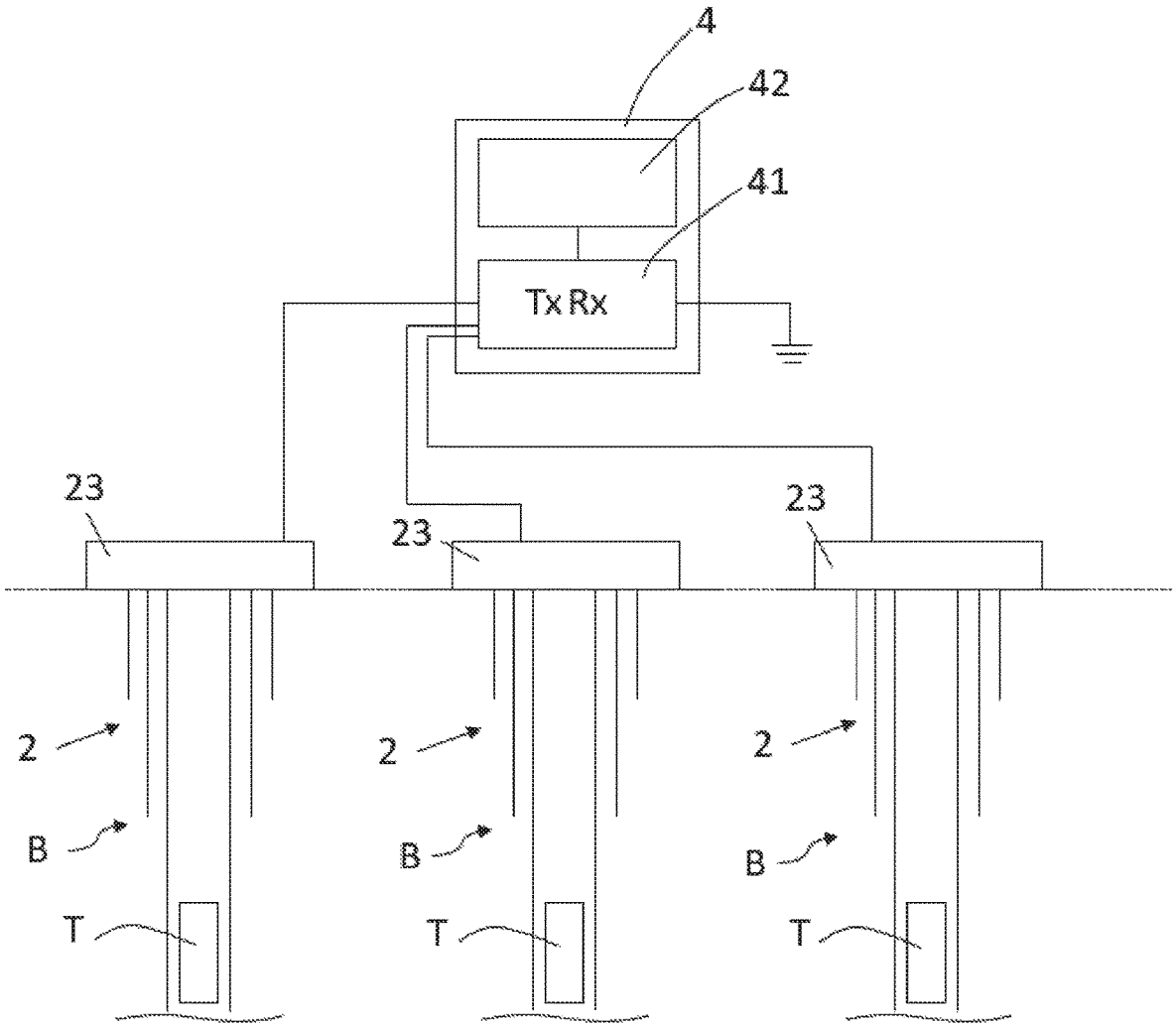
Figure 3:
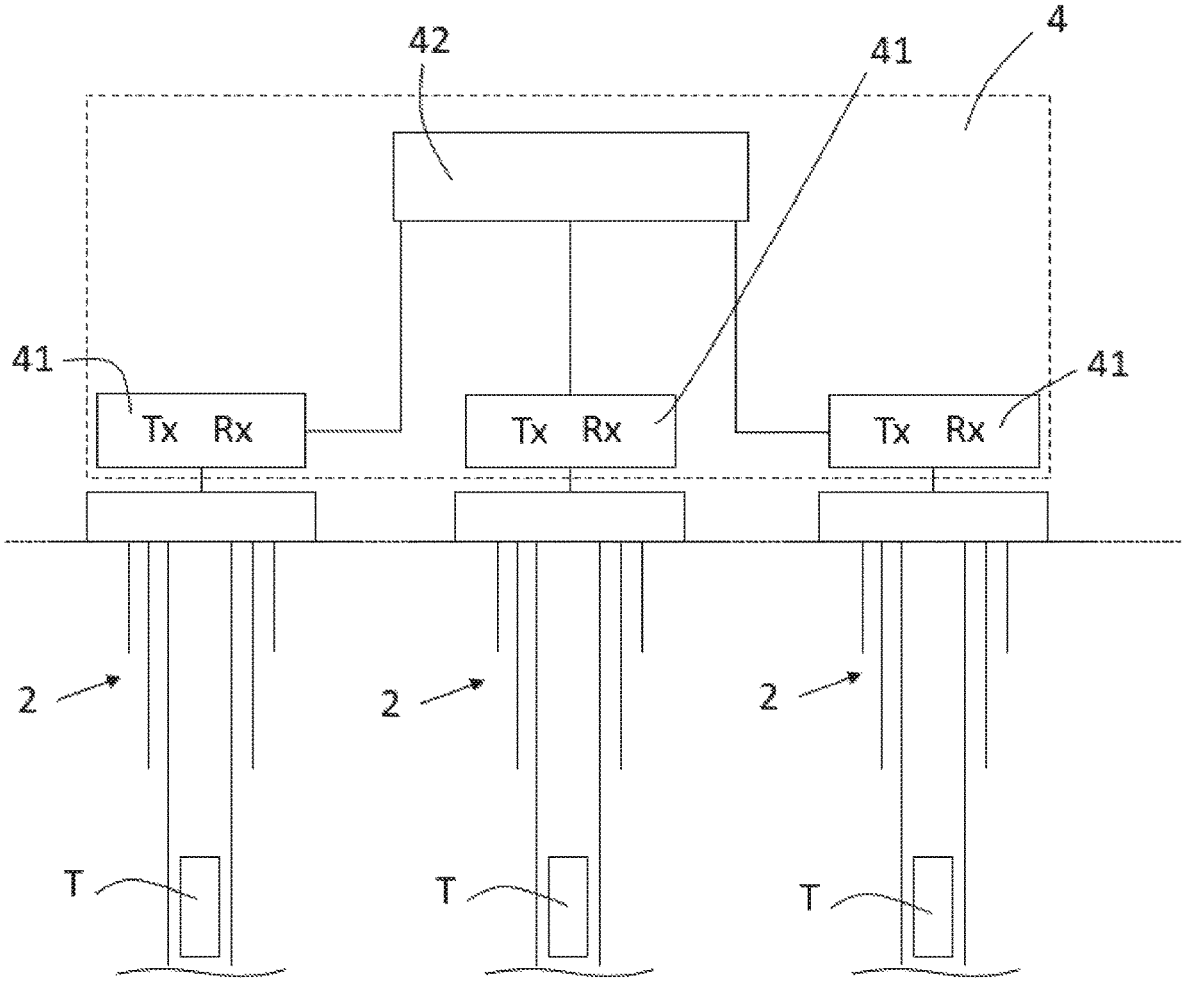
Figure 4:
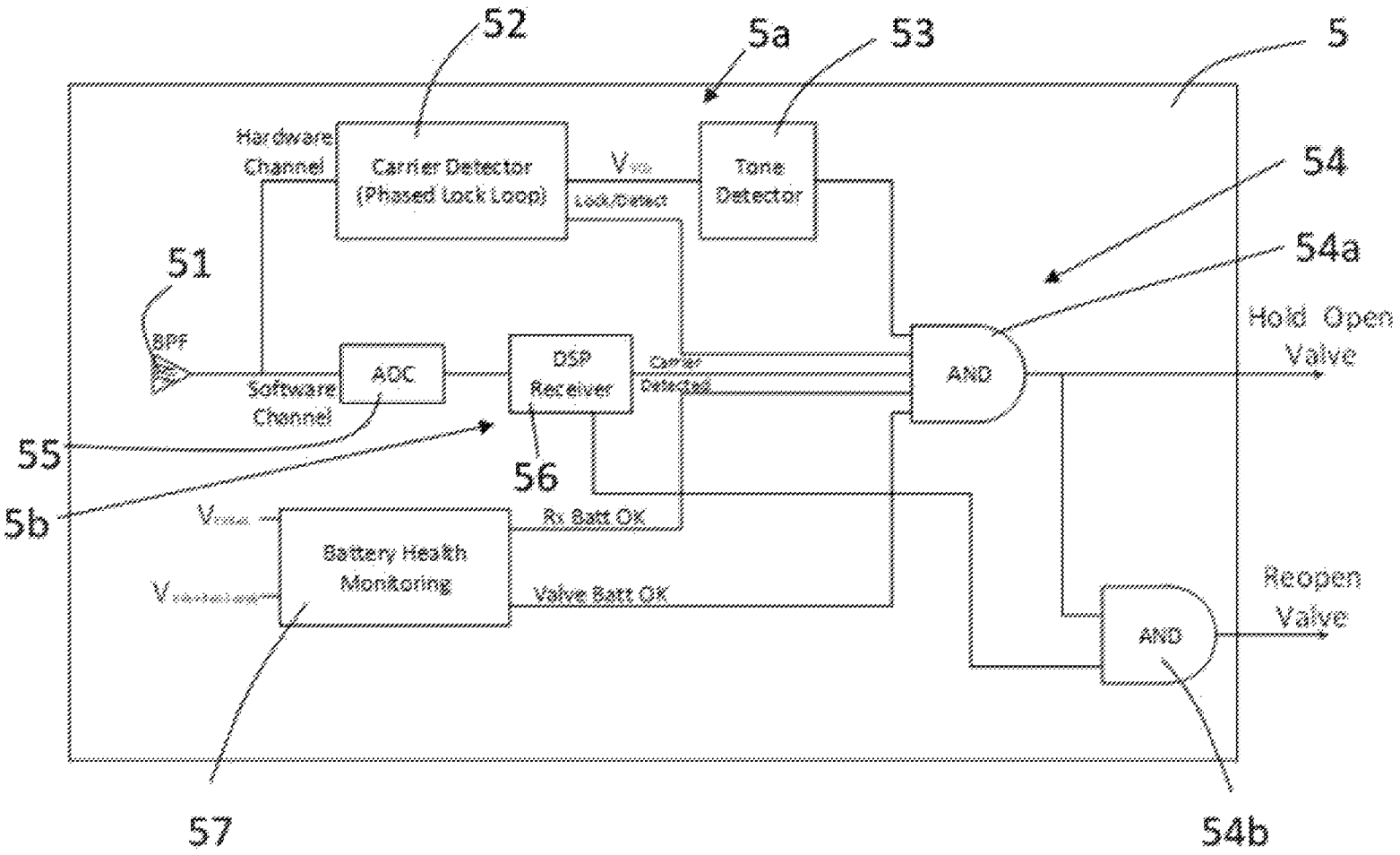
Figure 5A:
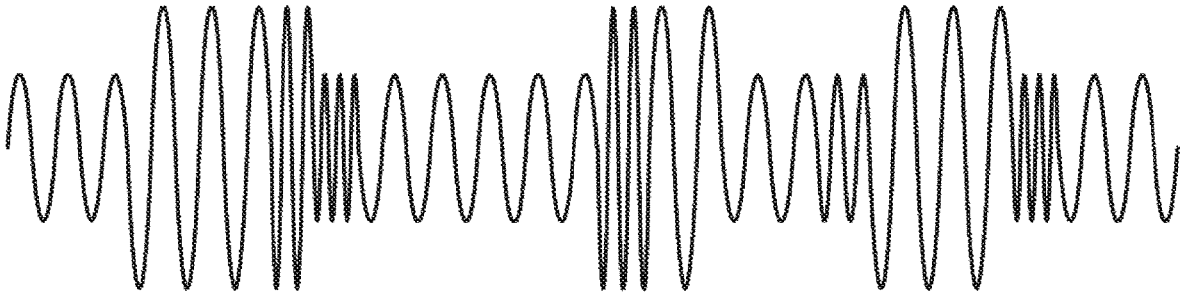
Figure 5B:
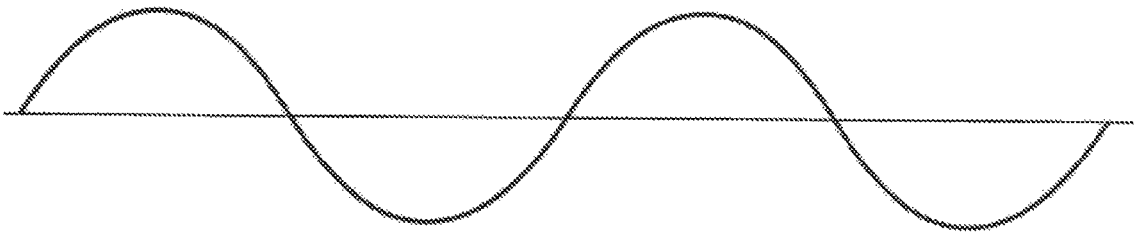
Figure 6A:
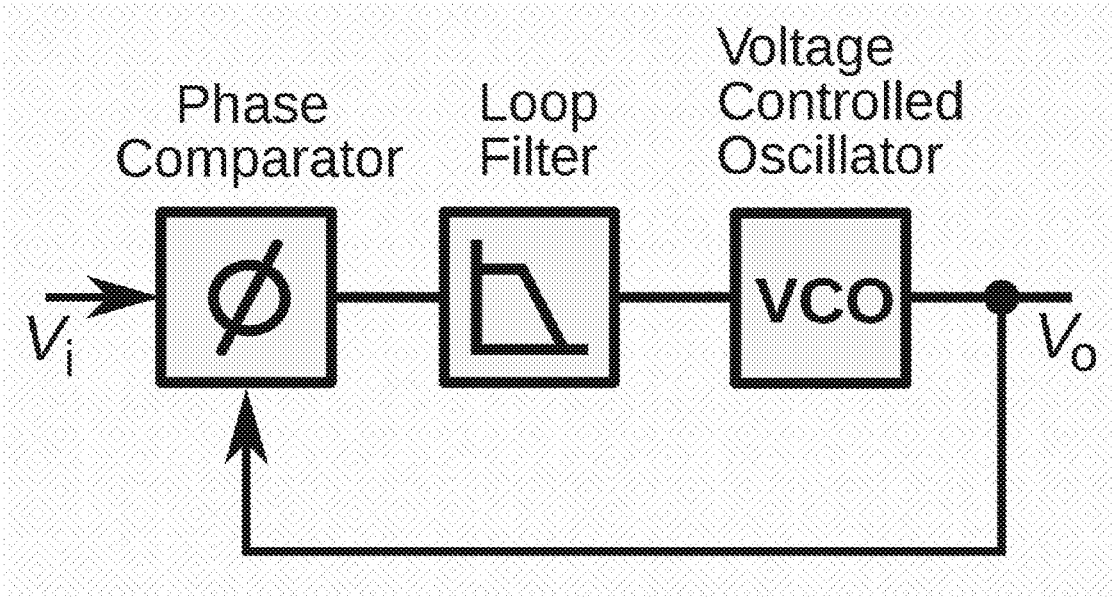
Figure 6B:
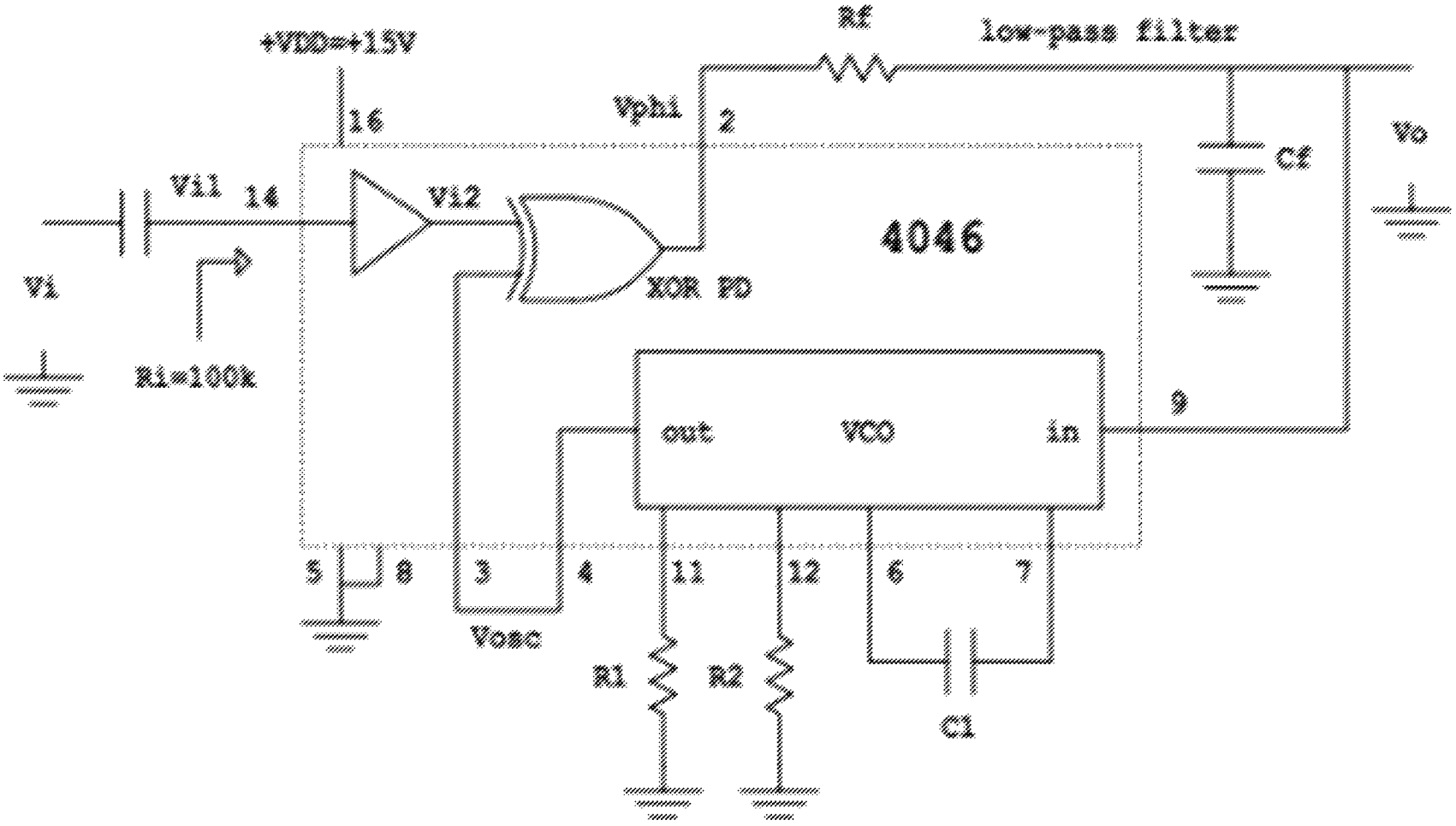
Figure 7:
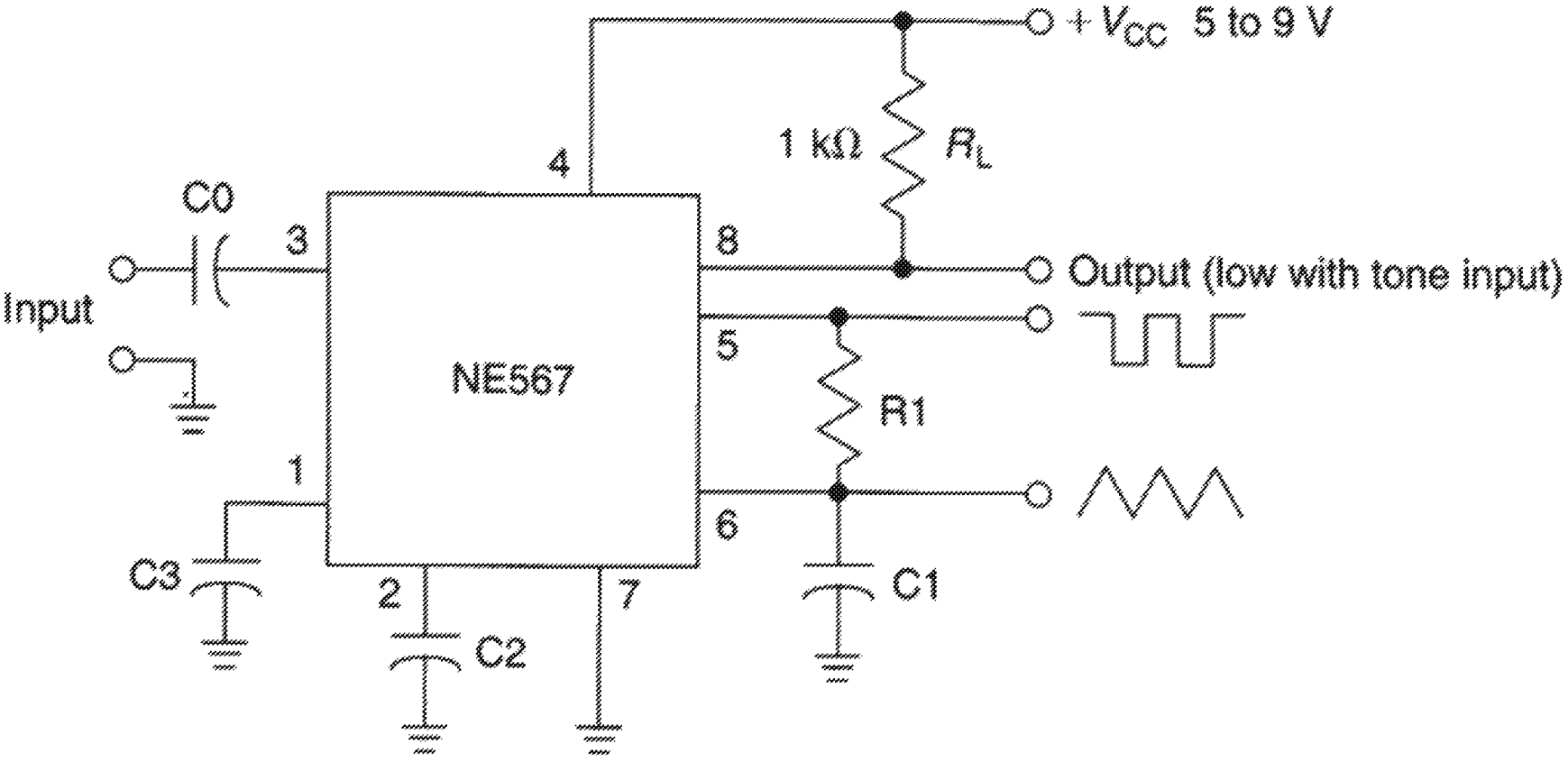

Embodiments of the present invention will now be described, by way of example only, with reference to the accompanying drawings in which:

FIG. 1 schematically shows a well installation including a subsurface safety valve operation system;

FIG. 2 schematically shows an alternative well installation including a subsurface safety valve operation system;

FIG. 3 shows a further alternative well installation including a subsurface safety valve operation system;

FIG. 4 schematically shows a downhole station of the subsurface safety valve operation system shown in FIG. 1 in more detail;

FIG. 5A schematically shows a signal as may be received at the downhole station of FIG. 4;

FIG. 5B schematically shows a signal as may be output from a carrier detector which forms part of the downhole station shown in FIG. 4;

FIGS. 6A and 6B show example implementations of a carrier detector of the downhole station shown in FIG. 4; and FIG. 7 shows an example implementation of a tone detector of the downhole station shown in FIG. 4.

FIG. 1 schematically shows a well installation, that is to say, an oil and/or gas well installation. In the present case the well installation comprises a producing well.

The well installation comprises well installation metallic structure 1 which comprises downhole metallic structure 2 progressing down into a borehole B provided in the formation F. The downhole metallic structure 2 comprises production tubing 21 and an appropriate plurality of casing runs 22. The present well installation is a platform well installation and includes a platform 3 provided above the level of the borehole B. Note that whilst in the well installation as shown in FIG. 1 there is a single borehole and this is provided directly below the platform 3. In other situations there may be multiple boreholes each provided with their own downhole metallic structure 2 and each arranged for feeding product back from the respective borehole to the platform 3. In such a circumstance some of the boreholes may not be directly under the location of the platform 3 but rather spaced away from it. However in such a case, the platform 3 will still be above the level of the respective boreholes even though not directly above those boreholes which are spaced away from the platform.

In the present specification the term "well installation" is used to include situations where there a plurality of boreholes with their own downhole metallic structure connected back to the platform 3. Thus such a plurality of boreholes which might be considered to be individual "wells" are considered for this specification to all be part of the "well installation".

The well installation of FIG. 1 comprises an electrical transmission system for use in the transmission of electrical communication signals between an out of hole station 4, in this case provided on the platform 3, and a downhole station 5 provided, in this case, within the production tubing 21. In the present embodiment, the out of hole station 4 comprises a transceiver portion 41 for applying electrical communication signals to the well installation metallic structure 1 and a control portion 42 connected to the transceiver portion 41.

In the present embodiment the downhole station 5 is provided in a downhole tool T which is retrofittable within the downhole metallic structure 2, in particular, in this case, within the production tubing 21. The downhole tool T in this embodiment comprises a subsurface safety valve V as well as the downhole station 5. In other cases the downhole station 5 might be provided separately to the subsurface safety valve. In the present embodiment this tool T is an example of a subsurface safety valve arrangement.

The downhole tool T may for example be deployed via wireline, and may, for example be located into a locator nipple above an existing (but perhaps failed) safety valve, suspended below an anchoring device, or below a wireline deployable lock.

The subsurface safety valve V includes a failsafe mechanism for driving the subsurface safety valve towards a closed position such as to obstruct the production tubing 21 and shut in the well as a default position. On the other hand the electrical transmission system is arranged for sending a hold open signal to the subsurface safety valve V to hold open the subsurface safety valve V in normal circumstances. This is achieved by the out of hole station 4 sending appropriate control signals to the downhole station 5 which are picked up by and cause the downhole station 5 to hold open the valve V whilst the signals are being received.

In the present embodiment the signals are picked up from the downhole metallic structure 2, in particular from the production tubing 21, via spaced contacts C provided on the tool T which are arranged for contacting with the inner surface of the production tubing 21.

As explained above, the out of hole station 4 is arranged for applying electrical signals to the well installation metallic structure 1, in this instance via the platform 3, so that wireless EM (electro-magnetic) signals may be transmitted into the well installation metallic structure 1, and particularly down the downhole metallic structure 2 for reception at, for example the downhole station 5.

In alternatives, electrical power may also be applied by the out of hole station 4 to the well installation metallic structure 1 for pick up and use at other locations such as at the downhole station 5. Similarly the out of hole station 4 may be arranged for picking up communication signals from the well installation metallic structure, in particular from the platform 3.

FIG. 2 shows an alternative well installation which comprises an electrical transmissions system of a similar type to that shown in FIG. 1. Here there are a plurality of bores B each having provided therein respective downhole metallic structure 2 and each having a downhole tool T of the type shown in FIG. 1 provided at a downhole location and including a downhole station 5 and subsurface safety valve V. Further again there is an out of hole station 4 comprising a transceiver portion 41 and a control portion 42. The transceiver portion 41 in this instance has an output connected to a respective well head which forms part of the metallic structure provided for each bore B. Thus the out of hole station 4 in the well installation shown in FIG. 2 is arranged for applying signals to the downhole metallic structure 2 in each of the boreholes B and hence the out of hole station 4 is able to communicate with the downhole station 5 in each of the boreholes B and correspondingly able to control operation of the respective valve V provided in each of the boreholes B.

FIG. 3 shows yet another alternative well installation which is similar to that shown in FIG. 2. However in this case, whilst there are again a plurality of bores B, each provided with its own downhole metallic structure 2 and each having a tool T of the type shown in FIG. 1 including a downhole station 5 and a subsurface safety valve V, here the out of hole station 4 has a different arrangement. In this instance one control portion 42 is provided but three separate transceiver portions 41 are provided. In this instance each transceiver portion 41 is associated with a particular one of the boreholes B and arranged for applying communication signals to the downhole structure 2 in that respective borehole B. Thus in this instance under the control of the control portion 42, signals may be applied to all of the sets of metallic structure 2 provided in the different boreholes B and all of these signals might be the same. However, in alternatives, at least sometimes signals may be applied to only some of the sets of metallic structure 2 and/or different signals may be provided to the different sets of metallic structure 2.

FIG. 4 schematically shows the downhole station 5 of FIG. 1 in more detail. As mentioned above, the downhole stations of this type may also be included in each of the downhole tools T included in the plurality of boreholes shown in the alternative well installations of FIG. 2 and FIG. 3.

The downhole station 5 is arranged for receiving signals picked up via the spaced contacts C on the downhole tool T. These signals are applied to a bandpass filter 51. After the bandpass filter 51, the path through the downhole station 5 splits into a hardware channel 5*a* and a software channel 5*b*. The hardware channel 5*a* is provided for handling hold valve open valve control signals and the software channel 5*b* is provided for handling auxiliary valve control signals.

In the present embodiment the hardware channel 5*a* comprises a carrier detector 52, a tone detector 53 and a logic gate arrangement 54 comprising two AND gates 54*a*, 54*b*.

The software channel 5*b* comprises an analogue to digital converter 55 and a digital signal processor receiver 56. Outputs of the digital signal processor receiver 56 are connected into the logic gate arrangement 54.

The downhole station 5 further comprises a battery health monitoring system 57 which again has outputs connecting into the logic gate arrangement 54. In the present embodiment the battery health monitoring system 57 is arranged for monitoring the health of a battery (not shown) used for powering the receive operation of the downhole station 5, that is to say powering the components mentioned above. Further in this embodiment the battery health monitoring system also monitors the health of a battery (not shown) used for powering operation of the valve V.

In the present embodiment the first AND gate 54*a* has five inputs and is arranged for outputting a hold open valve control signal to the valve V when appropriate signals are received on all of its inputs.

As mentioned above the valve V is arranged as a latch valve such that only a relatively small amount of power is required to hold the valve in the open position. As such the hold valve open control signal from the logic gate arrangement 54 need only be such as to hold this latch in position. The valve V is arranged such that if the hold valve open signal ceases, the valve V is delatched at that point allowing closure of the valve V under another source of power. For example the valve V may be spring biased towards the closed position and only held against closing by virtue of being latched open. In such a way when the latch releases, the valve V may be driven to a closed position under spring power alone.

In the present embodiment in order for the valve V to be held open signals must be received at the five inputs of the first AND gate 54*a*. A first of these inputs is connected to an output of the tone detector 53, the second of these inputs is connected to an output of the carrier detector 52, the third of these inputs is connected to a carrier detector output of the digital signal processor receiver 56, a fourth of the inputs is connected to an output of the battery health monitoring system 57 which indicates good health in the receive battery and a fifth of the inputs is connected to an output of the battery health monitoring system 57 which indicates the valve battery is in good condition.

Thus the valve V will only be held open where the signals are received from each of these inputting components. In practice this means that the hardware channel 5*a* must detect a carrier at the carrier detector 52 and must detect a tone at the tone detector 53. Further the digital signal processor receiver 56 must detect a carrier and the battery health monitoring system must detect a healthy receive battery and a healthy valve battery. If all of these conditions are met then the first AND gate 54*a* will output the appropriate signal for holding the valve open. On the other hand if any one of these signals is absent the output from the first AND gate 54*a* will cease and the valve V will be allowed to close.

There are various different ways that the hardware channel 5*a* might be implemented. The aim with the inclusion of the hardware channel 5*a* is to provide a very robust system for the detection of hold open valve signals transmitted from the surface, i.e. transmitted from the out of hole station 4. The hardware channel 5*a* is implemented using discrete components and non-programmable integrated circuits or "chips". This means that the hardware channel is not prone to failures that could arise due to software bugs or malfunctions. The hardware channel 5*a* is arranged to look for characteristics in the received signals which indicate the presence of a hold valve open control signal and only give the requisite outputs to the logic gate arrangement 54 when these are detected.

In the present implementation as mentioned above, the hardware channel 5*a* comprises a carrier detector 52 (which may be implemented as a phase locked loop) and a tone detector 53. The carrier detector 52 looks for the presence of a signal carrier with particular characteristics. In particular in this implementation it looks for a carrier having a particular frequency or frequency range. If this frequency or frequency range is detected then the carrier detector 52 will output an appropriate signal via this output into the first AND gate 54*a*.

On the other hand the tone detector 53 is arranged to detect a tone which has been modulated onto the carrier. The carrier detector 52 in this embodiment also serves to demodulate the tone from the carrier. Here again this tone is one which has been modulated onto the carrier at the out of hole station 4 to represent a hold open valve signal. The tone detector 53 will only output its output into the first AND gate 54*a* when a tone having the predetermined frequency or in the predetermined range of frequencies is detected. In this way, via the hardware channel, a hold valve open instruction will only be determined to have been received if the appropriate carrier is detected and the appropriate tone is detected.

The output from the first AND gate 54*a* also feeds in as an input into the second AND gate 54*b*. The second AND gate 54*b* has two inputs. As well as receiving an input from the output of the first AND gate 54*a* it has an input connected to a second output of the digital signal processor receiver 56. The second AND gate 54*b* has an output connected to the valve V for causing reopening of the valve in appropriate circumstances.

Thus if the valve V has been closed at some point, or starts in a closed position, then provided all the hold open conditions are met as determined by the first AND gate 54*a* then if the digital signal processor receiver 56 outputs a reopen signal, the second AND gate 54*b* produces a reopen instruction signal which is fed to the valve V to cause reopening of the valve. After this has occurred the valve V is back in a normal held open position and from this point forwards whether it is held open will be controlled by the presence or absence of the hold open valve signal output by the first AND gate 54*a*.

Further functionality can be obtained through use of the software channel 5*b*. If it is determined that the valve V should be closed even though appropriate hold open signals may be being received and detected by the hardware channel 5*a*, the digital signal processor receiver 56 can cause closing of the valve V by deliberately ceasing output of the carrier detected signal from the digital signal processor receiver 56. This then means that not all of the necessary signals are received by the first AND gate 54*a* so that the first AND gate 54*a* ceases to output the hold valve open instruction and the valve V is caused to close.

Note that in some implementations the software channel may be done away with if there is no desire to provide additional functionality in the system. However the provision of a software channel has particular advantages as will be clear from the present description.

As mentioned above in the present embodiment the battery health monitoring system 57 also monitors the health of two batteries and only provides its necessary outputs into the first AND gate 54*a* when good health is determined in both of these batteries. In alternatives the battery health monitoring system could be omitted and thus at the very simplest level, the downhole station may include only the hardware channel 5*a*. Alternatively the battery health monitoring system 57 might be provided but only used for monitoring the health of one battery—say a battery used for the receive functionality of the downhole station or a battery used for controlling operation of the valve.

FIG. 5A schematically shows (in idealised form) a signal of the type which may be received at the downhole station having passed through the bandpass filter 51. In this instance the signal received includes a common carrier signal which has been frequency modulated to apply a tone to the carrier which represents a hold open valve signal for detection by the hardware channel 5*a* and has been subjected to digital amplitude modulation so as to encode signals for reception via the software channel 5*b*.

FIG. 5B shows a wave form output from the carrier detector 52 into the tone detector 53. Here by virtue of the function of the carrier detector 52 operating as a phase locked loop the amplitude modulation has been stripped out/ignored by the carrier detector 52 and the tone used to frequency modulate the carrier so as to represent a hold valve open signal has been demodulated from the received signal.

On the other hand the software channel 5*b* processes the received signal shown in FIG. 5A to extract the digital signal encoded onto the carrier by amplitude modulation. This occurs at the analogue to digital converter 55 and the resulting digital signal is fed into the digital signal processor receiver 56 for decoding and processing.

As will be appreciated this digital signal as received by the digital signal processor receiver 56 can carry whatever information is required for operation of the system.

So for example, as alluded to above, this digital signal may include an instruction to force closure of the valve V in appropriate circumstances or include an appropriate instruction for reopening the valve V in the appropriate circumstances.

Furthermore other data may be encoded in this signal.

As an example the digital signal may include an address which identifies a particular valve to which a command carried in the digital signal relates. Thus in a system of the type shown in FIGS. 2 and 3 where there are multiple downhole tools T, each with a respective downhole station 5 and a respective valve V, this address may indicate a particular one of these valves V. Thus the signals applied by the out of hole station 4 may include a command to force closure of a particular one of the valves V and this may be identified by the address included in the digital signal encoded onto the common carrier and detected by the respective digital signal processor receiver 56. In this this way an instruction to close one of the valves but leave the other valves open can be sent. Similarly an instruction to reopen a particular one of the valves may be sent with an appropriate address such that only the valve V of interest is caused to reopen.

Note that whilst mention is made of using addresses to apply individual commands the individual valves in a system including multiple valves, in general terms the hold open valve signals applied to the well installation and as detected by the hardware channel 5*a* will be common to all of the valves in the system. That is to say a single signal, for example a tone of a particular frequency applied to a common carrier may be applied to a well installation including multiple valves and this used to hold open all of those valves V. Then alongside this, auxiliary control signals to individual valves may be sent.

Whilst in theory it would be possible to apply individual hold open valve signals for the different valves, say by assigning a different frequency to each valve, this would lead to a more complex system and as such might be expected to be less robust. Therefore in preferred implementations, whilst addressing may be used for particular valves for the additional functionality which may be achieved via the software channel, a common hold valve open signal for processing via the hardware channel is preferably applied.

FIG. 6A schematically shows at block diagram level an implementation of the carrier detector 52 as a phase locked loop. Further FIG. 6B shows an example circuit diagram for implementing such a carrier detector using discrete components and non-programmable integrated circuits—in this case a phase locked loop integrated circuit 4046 which is commercially available from Texas Instruments.

Similarly FIG. 7 shows an example implementation of a tone detector 53 implemented using only discrete components and non-programmable integrated circuits—in this case a tone decoder integrated circuit NE567 which is commercially available from Phillips.

Note that, whilst in the present implementation frequency modulation is used to encode hold valve open signals onto the carrier and these are detected using a phase locked loop based carrier detector 52 and a tone detector 53 in the hardware channel and signals are modulated onto the carrier using digital amplitude modulation for pick up by the software channel, different signalling regimes may be used.

It is useful if the signalling regimes for the two channels are orthogonal to one another. That is to say, it is useful if the signals applied for pick up by the software channel are chosen so as to be independent from the signals which are to be picked up via the hardware channel. The use of frequency modulation in one case and amplitude modulation in the other case are examples of orthogonal signalling techniques. However there are other alternatives which might be used.

As an example, frequency shift keying as a particular type of frequency modulation may be used for encoding the hold valve open signals onto a carrier. In such a case the same type of carrier detector 52 and tone detector 53 arrangement described above may be used but the output signal at the VCO output of the carrier detector as fed into the tone detector 53 would be closer to a square wave than the sine wave form shown in FIG. 5B.

Amplitude modulation might be used to apply the hold valve open signals. In this case an envelope detector would be provided between a phase locked loop and a tone detector in the hardware channel.

In general M-ARY modulation methods may be used where the modulation selected for encoding the hold valve open signals is orthogonal to the modulation selected for encoding the auxiliary signals to be received via the software channel.

The out of hole station 4 may be arranged to accept an input from a platform's ESD system (emergency shutdown system) such that when an ESD trip occurs it shall result in automatic valve closure. This might be implemented by ceasing to transmit the hold open signals so that these cease to be detected by the hardware channel. Alternatively (or in addition) the instruction to close the valve V can be sent via the software channel.

While systems of the above type might be implemented in a full duplex or half duplex system such that the downhole station 5 is able to communicate back towards the out of hole station 4, in at least some implementations it is preferred to implement the system as a simplex system. That is to say where the surface transceiver 41 in fact is only a transmitter and the downhole station 5 is arranged to operate only as a receiver. This may help lead to a more robust system.

Where the current implementation is used including a carrier detector 52 implemented using a phase locked loop, the carrier detector 52 has a natural time constant determined by the values of the components used in setting up the circuit as shown in FIG. 6B. This time constant may be selected to have a certain period. This means that if an expected signal is lost there will be a predetermined period which will pass before the signal is seen as being lost. That is to say the output of the carrier detector 52 will not immediately cease as soon as the absence of the expected carrier is seen at the downhole station 5 but rather cease after a time which is determined by the time constant. This time constant may be selected to avoid unwanted and unnecessary closures of the valve V if there is a very brief absence of signal or very brief drop off in the strength of the signal received at the downhole station 5.

Because there may be this finite delay in the valve V being caused to close by the failure of reception of the hold open valve signals, in emergency situations it may be preferable to send (or also send) a close immediately signal via the signals to be picked up by the software channel in at least some circumstances. This may lead to initiation of closing of the valve more quickly than relying on ceasing of the hold open valve signals.

Note also that time constants in the hardware channel will likely be affected by temperature. Taking this into account a longer than optimal time constant (at a mean or normal temperature) may be chosen in the hardware channel to avoid unwanted valve closures at extremes of temperature.

Signals

The electrical signals referred to in this specification may also be termed Electromagnetic (EM) (sometimes referred to as Quasi-Static (QS)) wireless signals. In at least the downhole environment, communication using such signals is normally in the frequency bands of: (selected based on propagation characteristics) sub-ELF (extremely low frequency) <3 Hz (normally above 0.01 Hz);

ELF 3 Hz to 30 Hz;

SLF (super low frequency) 30 Hz to 300 Hz;

ULF (ultra low frequency) 300 Hz to 3 kHz; and,

VLF (very low frequency) 3 kHz to 30 kHz.

Sub-ELF to SLF are particular suited to communications in the current system. Preferrably signals will be 1000 Hz or below, more preferably 100 Hz or below. The nomenclature used for these ranges is defined by the International Telecommunication Union (ITU).

To control and direct current advantageously, a number of different techniques may be used. For example one or more of: use of an insulating coating or spacers on well tubulars; selection of well control fluids or cements within or outwith tubulars to electrically conduct with or insulate tubulars; use of a toroid of high magnetic permeability to create inductance and hence an impedance; use of an insulated wire, cable or insulated elongate conductor for part of the transmission path or any antenna.

Various means for receiving a transmitted signal can be used, these may include detection of a current flow; detection of a potential difference; use of a dipole antenna; use of a coil antenna; use of a toroidal transformer; use of a Hall effect or similar magnetic field detector; use of sections of the well metalwork as part of a dipole antenna.

Where the phrase "elongate conductor" is used, for the purposes of EM communication, this could mean any elongate electrical conductor including: liner; casing; tubing or tubular; coil tubing; sucker rod; wireline; drill pipe; slickline or coiled rod.

The invention claimed is:

1. A subsurface safety valve control system downhole station for provision in downhole metallic structure of a well installation which comprises a subsurface safety valve having an open state allowing flow through the valve and a closed state obstructing flow through the valve, wherein the downhole station is arranged for picking up electrical signals from the downhole metallic structure to obtain valve control signals and for outputting control signals for controlling the subsurface safety valve in dependence on the signals picked up from the downhole metallic structure, wherein the downhole station comprises a hardware electronics channel for handling electrical signals picked up from the downhole metallic structure and the hardware electronics channel is arranged for detecting the presence and/or absence of hold valve open signals, and the downhole station is configured to cause the subsurface safety valve to be held in the open state whilst expected hold valve open signals are received and is configured to cause the subsurface safety valve to move to the closed state in the absence of expected hold valve open signals, wherein the downhole station is configured to detect, from the electrical signals picked up from the downhole metallic structure, auxiliary control signals which are distinct from the hold valve open signals, wherein the auxiliary control signals and the hold valve open signals are carried by a common carrier signal, and wherein the auxiliary control signals comprise valve movement auxiliary control signals and the downhole station is configured to cause the subsurface safety valve to move in response to the valve movement auxiliary control signals.

2. A subsurface safety valve control system downhole station according to claim 1 comprising a software controlled electronics channel for handling electrical signals picked up from the downhole metallic structure.

3. A subsurface safety valve control system downhole station according to claim 2 in which the software controlled electronics channel is provided for detecting auxiliary control signals which are distinct from hold valve open signals.

4. A subsurface safety valve control system downhole station according to claim 1 in which the hardware electronics channel comprises a carrier detector arrangement for detecting in received signals the presence of a carrier signal having a frequency within a predetermined frequency range; and the hardware electronics channel comprises a demodulator for demodulating received signals to acquire a demodulated signal and a detection arrangement for detecting a predetermined signal characteristic in the demodulated signal which predetermined signal characteristic indicates that the received signals comprise hold valve open signals, wherein the downhole station is arranged to hold the valve open in response to:

i) the detection of a carrier signal having a frequency within a predetermined frequency range; and ii) the determination that the received signals comprise hold valve open signals from the detection of the predetermined signal characteristic in the demodulated signal.

5. A subsurface safety valve control system downhole station according to claim 1 in which the auxiliary control signals and hold valve open signals are modulated on and carried by a common carrier signal.

6. A subsurface safety valve control system downhole station according to claim 5 in which the auxiliary control signals are applied to the respective carrier signal using an orthogonal modulation technique to a modulation technique by which the hold valve open signals are applied to the respective carrier signal.

7. A subsurface safety valve control system downhole station according to claim 5 in which the hold valve open signals are encoded by frequency modulation on to a common carrier signal and the auxiliary control signals are encoded by amplitude modulation on to the common carrier signal.

8. A subsurface safety valve control system downhole station according to claim 1 in which the auxiliary control signals comprise forced close signals for causing movement of the subsurface safety valve to the closed state irrespective of whether hold open signals are received.

9. A subsurface safety valve control system downhole station according to claim 1 in which the auxiliary control signals comprise re-open signals for causing re-opening of the subsurface safety valve when in the closed state.

10. A subsurface safety valve control system downhole station according to claim 1 in which the auxiliary control signals are encoded onto the common carrier signal as digital signals.

11. A subsurface safety valve control system downhole station according to claim 1 in which the auxiliary control signals are encoded onto the common carrier signal using digital amplitude modulation.

12. A subsurface safety valve control system downhole station according to claim 1 in which the subsurface safety valve has an associated address, and the auxiliary control signals carry an address so as to allow determination at the downhole station as to whether a received auxiliary control signal is intended for the subsurface safety valve.

13. A subsurface safety valve control system downhole station according to claim 1 in which the downhole station is arranged for determining whether at least one hold open condition is satisfied such that the valve should be held open and for outputting a hold open control signal to the valve when it is determined that the at least one hold open condition is satisfied.

14. A subsurface safety valve control system downhole station according to claim 13 in which the downhole station is arranged such that re-open signals for causing re-opening of the subsurface safety valve when in the closed state, will only cause re-opening of the subsurface safety valve when the downhole station determines that said at least one hold open condition is satisfied.

15. A subsurface safety valve control system downhole station according to claim 13 in which the downhole station comprises a logic gate arrangement for determining whether at least one hold open condition is satisfied.

16. A subsurface safety valve control system downhole station according to claim 15 in which the downhole station comprises a battery health monitoring system for monitoring the health of at least one battery at the downhole station and outputting a signal to indicate that said at least one battery is healthy, said output of the battery health monitoring system being fed into the logic gate arrangement.

17. A subsurface safety valve arrangement for installation in downhole metallic structure in a well installation, the subsurface safety valve arrangement comprising a subsurface safety valve having an open state allowing flow through the valve and a closed state obstructing flow through the valve, and a downhole station according to claim 1.

18. A well installation comprising downhole metallic structure comprising downhole metallic pipe for directing oil and/or gas towards the surface, a subsurface safety valve having an open state allowing flow through the valve and a closed state obstructing flow through the valve and hence obstructing flow, in the downhole metallic pipe, of oil and/or gas towards the surface, and a control arrangement for controlling operation of the subsurface safety valve, wherein the control arrangement comprises an out of hole station and a downhole station according to claim 1.

19. A well installation according to claim 18 which comprises a plurality of subsurface safety valves each with a respective associated address and each having an associated downhole station.

20. A well installation according to claim 19 in which the well installation is a multi-lateral well installation with a main bore and at least one lateral bore branching off of the main bore and a first subsurface safety valve is provided in the main bore and a second subsurface safety valve is provided in a bore amongst the at least one lateral bore.

21. A well installation according to claim 19 in which the well installation comprises a number of separate boreholes each provided with its own metallic structure and each provided with a respective subsurface safety valve and associated downhole station.

22. A subsurface safety valve control method for controlling a subsurface safety valve provided in a well installation comprising downhole metallic structure comprising downhole metallic pipe for directing oil and/or gas towards the surface, wherein the subsurface safety valve has an open state allowing flow through the valve and a closed state obstructing flow through the valve and hence obstructing flow, in the downhole metallic pipe, of oil and/or gas towards the surface, and the control method comprises:

using an out of hole station to transmit hold open valve control signals and auxiliary control signals to a downhole station by applying electrical signals to the downhole metallic structure;

using the downhole station to pick up the hold open valve control signals and the auxiliary control signals from the downhole metallic structure; and using the downhole station to cause the subsurface safety valve to be held in the open state whilst expected hold valve open signals are received and cause the subsurface safety valve to move to the closed state in the absence of expected hold valve open signals, wherein the auxiliary control signals comprise valve movement auxiliary control signals and the downhole station is configured to cause the subsurface safety valve to move in response to the valve movement auxiliary control signals.

23. A subsurface safety valve control system downhole station for provision in downhole metallic structure of a well installation which comprises a subsurface safety valve having an open state allowing flow through the valve and a closed state obstructing flow through the valve, wherein the downhole station is arranged for picking up electrical signals from the downhole metallic structure to obtain valve control signals and for outputting control signals for controlling the subsurface safety valve in dependence on the signals picked up from the downhole metallic structure, wherein the downhole station comprises a hardware electronics channel for handling electrical signals picked up from the downhole metallic structure and the hardware electronics channel is arranged for detecting the presence and/or absence of hold valve open signals, and the downhole station is configured to cause the subsurface safety valve to be held in the open state whilst expected hold valve open signals are received and is configured to cause the subsurface safety valve to move to the closed state in the absence of expected hold valve open signals, wherein the downhole station is configured to detect, from the electrical signals picked up from the downhole metallic structure, auxiliary control signals which are distinct from the hold valve open signals, wherein the auxiliary control signals and the hold valve open signals are carried by a common carrier signal, and wherein the auxiliary control signals comprise valve movement auxiliary control signals and the downhole station is configured to cause the subsurface safety valve to move in response to the valve movement auxiliary control signals.

24. A subsurface safety valve control system downhole station for provision in downhole metallic structure of a well installation which comprises a subsurface safety valve having an open state allowing flow through the valve and a closed state obstructing flow through the valve, wherein the downhole station is arranged for picking up electrical signals from the downhole metallic structure to obtain valve control signals and for outputting control signals for controlling the subsurface safety valve in dependence on the signals picked up from the downhole metallic structure, wherein the downhole station comprises a hardware electronics channel for handling electrical signals picked up from the downhole metallic structure and the hardware electronics channel is arranged for detecting the presence and/or absence of hold valve open signals, and the downhole station is configured to cause the subsurface safety valve to be held in the open state whilst expected hold valve open signals are received and is configured to cause the subsurface safety valve to move to the closed state in the absence of expected hold valve open signals, wherein the hardware electronics channel comprises a carrier detector arrangement for detecting in received signals the presence of a carrier signal having a frequency within a predetermined frequency range; and the hardware electronics channel comprises a demodulator for demodulating received signals to acquire a demodulated signal and a detection arrangement for detecting a predetermined signal characteristic in the demodulated signal which predetermined signal characteristic indicates that the received signals comprise hold valve open signals, wherein the downhole station is arranged to hold the valve open in response to:

i) the detection of a carrier signal having a frequency within a predetermined frequency range; and ii) the determination that the received signals comprise hold valve open signals from the detection of the predetermined signal characteristic in the demodulated signal.

25. A subsurface safety valve control system downhole station for provision in downhole metallic structure of a well installation which comprises a subsurface safety valve having an open state allowing flow through the valve and a closed state obstructing flow through the valve, wherein the downhole station is arranged for picking up electrical signals from the downhole metallic structure to obtain valve control signals and for outputting control signals for controlling the subsurface safety valve in dependence on the signals picked up from the downhole metallic structure, wherein the downhole station comprises a hardware electronics channel for handling electrical signals picked up from the downhole metallic structure and the hardware electronics channel is arranged for detecting the presence and/or absence of hold valve open signals, and the downhole station is configured to cause the subsurface safety valve to be held in the open state whilst expected hold valve open signals are received and is configured to cause the subsurface safety valve to move to the closed state in the absence of expected hold valve open signals, wherein the downhole station is arranged configured to detect, from the electrical signals picked up from the downhole metallic structure, auxiliary control signals which are distinct from the hold valve open signals, and the auxiliary control signals are encoded onto a common carrier signal with the hold open valve signals as digital signals, and wherein the auxiliary control signals comprise valve movement auxiliary control signals and the downhole station is configured to cause the subsurface safety valve to move in response to the valve movement auxiliary control signals.

26. A subsurface safety valve control system downhole station according to claim 25, wherein the auxiliary control signals are encoded onto the common carrier signal using digital amplitude modulation.

27. A subsurface safety valve control system downhole station for provision in downhole metallic structure of a well installation which comprises a subsurface safety valve having an open state allowing flow through the valve and a closed state obstructing flow through the valve, wherein the downhole station is arranged for picking up electrical signals from the downhole metallic structure to obtain valve control signals and for outputting control signals for controlling the subsurface safety valve in dependence on the signals picked up from the downhole metallic structure, wherein the downhole station comprises a hardware electronics channel for handling electrical signals picked up from the downhole metallic structure and the hardware electronics channel is arranged for detecting the presence and/or absence of hold valve open signals, and the downhole station is configured to cause the subsurface safety valve to be held in the open state whilst expected hold valve open signals are received and is configured to cause the subsurface safety valve to move to the closed state in the absence of expected hold valve open signals, wherein the downhole station is arranged configured to detect, from the electrical signals picked up from the downhole metallic structure, auxiliary control signals which are distinct from the hold valve open signals, and the subsurface safety valve has an associated address, and the auxiliary control signals carry an address so as to allow determination at the downhole station as to whether a received auxiliary control signal is intended for the subsurface safety valve, and wherein the auxiliary control signals comprise valve movement auxiliary control signals and the downhole station is configured to cause the subsurface safety valve to move in response to the valve movement auxiliary control signals.

28. A subsurface safety valve control system downhole station for provision in downhole metallic structure of a well installation which comprises a subsurface safety valve having an open state allowing flow through the valve and a closed state obstructing flow through the valve, wherein the downhole station is arranged for picking up electrical signals from the downhole metallic structure to obtain valve control signals and for outputting control signals for controlling the subsurface safety valve in dependence on the signals picked up from the downhole metallic structure, wherein the downhole station comprises a hardware electronics channel for handling electrical signals picked up from the downhole metallic structure and the hardware electronics channel is arranged for detecting the presence and/or absence of hold valve open signals, and the downhole station is configured to cause the subsurface safety valve to be held in the open state whilst expected hold valve open signals are received and is configured to cause the subsurface safety valve to move to the closed state in the absence of expected hold valve open signals, wherein the downhole station is configured for determining whether at least one hold open condition is satisfied such that the valve should be held open and for outputting a hold open control sign alto the valve when it is determined that the at least one hold open condition is satisfied, the downhole station comprises a logic gate arrangement for determining whether at least one hold open condition is satisfied, and the downhole station comprises a battery health monitoring system for monitoring the health of at least one battery at the downhole station and outputting a signal to indicate that said at least one battery is healthy, said output of the battery health monitoring system being fed into the logic gate arrangement.

* * * * *